United States Patent [19]

Podlesak

[11] Patent Number: 5,020,421

[45] Date of Patent: Jun. 4, 1991

[54] WORKING CYLINDER WITHOUT PISTON ROD

[75] Inventor: Heinz Podlesak, Munich, Fed. Rep. of Germany

[73] Assignee: Knorr-Bremse AG, Fed. Rep. of Germany

[21] Appl. No.: 519,461

[22] Filed: May 7, 1990

[30] Foreign Application Priority Data

May 5, 1989 [DE] Fed. Rep. of Germany ..... 3914889

[51] Int. Cl.[5] ..... F01B 9/00

[52] U.S. Cl. ..... 92/137; 92/165 R; 92/168; 277/208; 277/188 R; 277/123; 277/124

[58] Field of Search ..... 92/137, 165 R, 167, 92/168; 277/123, 124, 188 R, 205

[56] References Cited

U.S. PATENT DOCUMENTS

| | | | |
|---|---|---|---|
| 2,666,658 | 1/1954 | Laucks | 92/137 |
| 4,057,257 | 11/1977 | Berg | 92/137 |
| 4,121,840 | 10/1978 | Berg | 92/165 R |
| 4,522,113 | 6/1985 | Tsuno | 92/168 |
| 4,526,386 | 7/1985 | Repella | 277/188 R |
| 4,807,890 | 2/1989 | Gorman et al. | 92/168 |

FOREIGN PATENT DOCUMENTS

| | | | |
|---|---|---|---|
| 2404244 | 8/1975 | Fed. Rep. of Germany | 92/137 |

*Primary Examiner*—John T. Kwon
*Assistant Examiner*—Thomas Denion
*Attorney, Agent, or Firm*—Pollock, Vande Sande & Priddy

[57] ABSTRACT

A working cylinder without piston rod in the form of a band cylinder. The band (3) in the cylinder covers (8) penetrates a receiving chamber (10) for a sealing and a guide member. Each sealing member comprises a strip-like sealing element on both sides of the band, made of elastic material and, on the piston side, in the form of a lip seal. The sealing elements (12, 13) are installed in the receiving chamber (10) with elastic pre-stressing relative to the band (3). Each guide member facing the sealing member has on both sides of the band (3) a rib-like guide element (23, 24), which is also elastically forced against the band (3) by pre-stressing the sealing elements (12, 13). The guide elements (23, 24) terminate in stop faces (28) with clearance (29) in front of the wall (15) of the receiving chamber (10). The result is that the band (3) can be deflected elastically from its desired position only by the amount of the clearance (29); subsequently the guide elements (23, 24) brace themselves form-lockingly against the cylinder cover (8) and prevent any further deflection of the band.

11 Claims, 2 Drawing Sheets

WORKING CYLINDER WITHOUT PISTON ROD

FIELD OF THE INVENTION

The invention relates to a working cylinder without piston rod, having at least one band, which connects a piston to an output member and which sealedly and moveably penetrates, coaxially or concentrically to the piston, at least one cylinder cover, arranged at one end of a cylinder pipe accommodating the piston. The cylinder cover has a receiving chamber, which is penetrated by the band and which is wider than the band, has laterally rounded ends, and in which, facing the piston, there are two identical, strip-like sealing elements, which are made of an elastic material and are forced against both wide sides of the band by bracing against the wall of the receiving chamber with pre-stressing, and, facing away from the piston, there is a band guide, which is made of a form-stable material, has a slot for the band to pass through, and can also be braced against the wall of the receiving chamber.

BACKGROUND OF THE INVENTION

Such a band cylinder is known from DE-AS 1 293 037, in which the sealing elements are cylindrical bars of elastic material and arranged in pairs on both sides of the band and the band guide comprises a plate, which is provided with a slot for the band to pass through and which is held detachably at the cylinder cover by means of a cover piece. The cover piece includes an expansion of the receiving chamber, which is filled with felt abutting the band. When the band is moved, the cylindrical bars and the felt generate a relatively large degree of friction, thus impairing the function of the working cylinder. In addition, the differing mounting supports of the cylindrical bars, band guide and felt can cause a center offset of these parts, thus causing a further reduction in the function.

The band of such working cylinders is usually designed as a flat steel or plastic band.

From Austrian patent 364 621 it is known to arrange a lubricant pad for the band in front of a seal designed like a conical plug; when the band is moved, the lubricated band is supposed to force the seal through friction into a housing cone and thereby to cause a sealing contact pressure against the band. Despite the lubrication, here, too there is noticeable friction; in addition, no band guide is provided.

German published patent application 24 04 244 discloses a band cylinder which differs from the afore-mentioned features and which, to seal the band, comprises a bar-like lip seal supported by a pressure medium and having one lip which abuts the wide side of the band and a second lip which abuts the wall of a receiving chamber for the lip seal.

SUMMARY OF THE INVENTION

The object of the invention is to design a working cylinder without piston rod of the afore-mentioned kind in such manner that a good band guide is assured without undesirable center offsetting relative to the band seal, wherein at the same time friction from the band guide and band seal when the band moves are limited. However, the band guide should be capable of guiding the band reliably even when large deflections occur.

This problem is solved in accordance with the invention for a working cylinder of the afore-mentioned kind in that each sealing element, whose outer contour essentially corresponds to the contour of the wall of the receiving chamber, exhibits on its side facing away from the piston a first groove that extends parallel to the wide side of the band and transversely to said band and is open in the direction of said band; that the band guide in the band plane is divided into two identical guide elements, each guide element having a bar-like body extending into the first groove; that each sealing element has in the center region of its longitudinal extension a second groove, starting from the first groove and extending at right angles to said groove and leading to the outer contour; that each guide element has an extension which extends into the second groove and which ends with clearance in front of the wall of the receiving chamber with a stop face; and that each guide element on the side of the extension has a pin shoulder, which extends parallel to said extension and also ends with clearance in front of the wall of the receiving chamber with a stop face and which is located in a bore-like recess of the sealing element.

The result of this design of the working cylinder is that the band seal and the band guide are arranged in a common receiving chamber of the cylinder cover so that, even with large dimensional differences of the cylinder cover, no center offsetting can occur between the band seal and the band guide. The dimensional tolerances are absorbed by the elasticity of the band seal, whose elasticity simultaneously pre-stresses the band guide in the direction of the band. Only when large deflections occur at the band, is this elastic pre-stressing of the band guide overcome and, after slight lateral displacement of the band guide corresponding to the clearance, said band guide abuts directly against the cylinder cover and can thus reliably prevent the band from being further deflected.

BRIEF DESCRIPTION OF THE DRAWING

In order that the invention may be more clearly understood, reference will now be made to the accompanying drawings, in which several embodiments of the working cylinder according to the invention are shown for purposes of illustration, and in which

FIG. 2 is a view from the piston side;

FIG. 3 is a top plan view; and

FIG. 4 is a view of the side facing away from the piston;

FIG. 5 is a section view along line I—I in FIG. 2; and

FIG. 6 is a section view along line II—II of FIG. 2;

FIG. 7 is a section view corresponding to that of FIG. 6, showing the sealing and guide elements built in;

DESCRIPTION OF THE PREFERRED EMBODIMENTS

Figure 1:
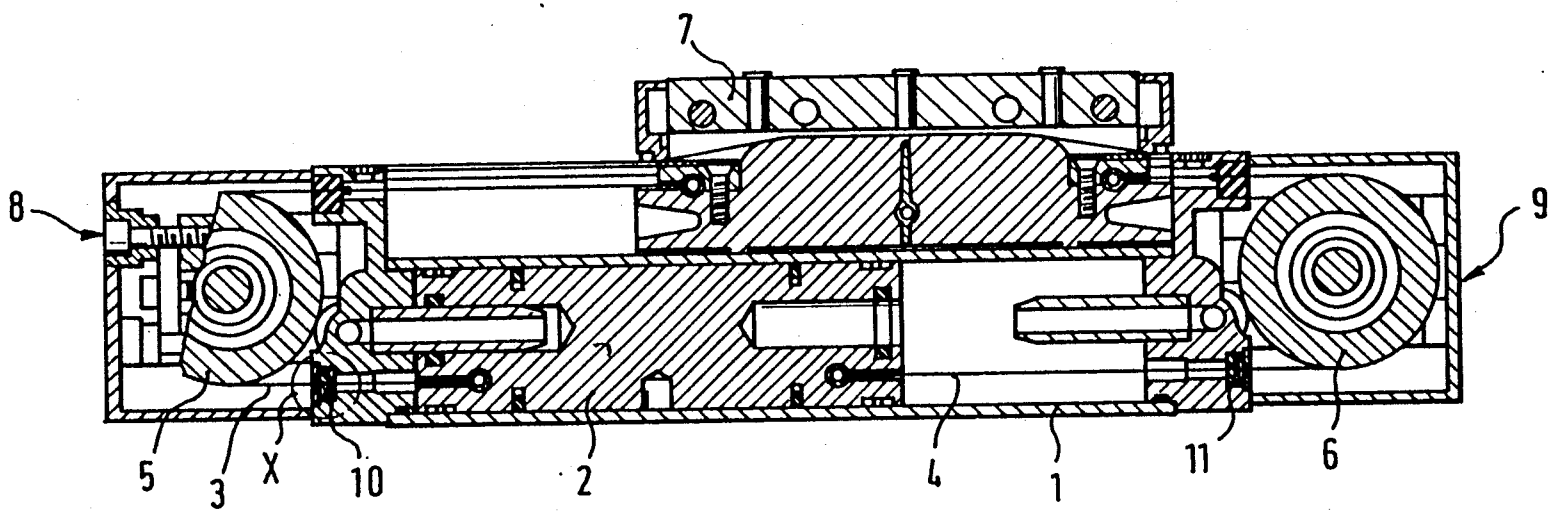
FIG. 1 is a longitudinal section view of a working cylinder.
Figure 3:
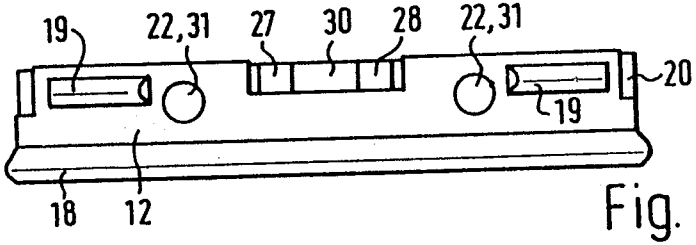

The working cylinder without piston rod has, in a cylinder pipe 1, a sealed, movable piston 2, from both side of which bands 3 and 4, of steel or plastic, lead via guide pulleys 5 and 6 to an output member 7. Thus, the working cylinder is a typical band cylinder. Cylinder pipe 1 is closed on both sides by means of cylinder covers 8 and 9 in which guide pulleys 5 and 6 are positioned. Steel bands 3 and 4 penetrate the sealing and guide members, which are arranged in their sections between piston 2 and guide pulleys 5 or 6 in receiving chambers 10 and 11 of the cylinder covers 8 and 9 and which are described in detail below. The particular feature X in FIG. 1, i.e., the receiving chamber 10, is shown on an enlarged scale in FIG. 7. The receiving chamber 10 has an elongated shape, extending transversely to the longitudinal direction of the band, its length being greater than the width of the band, and it is rounded off at both ends. In plan view, the receiving chamber 10 has a shape resembling that of FIG. 3 of the afore-mentioned DE-AS 1 293 037. Receiving chamber 11 corresponds in design and layout to a mirror image of receiving chamber 10.

Figure 7:
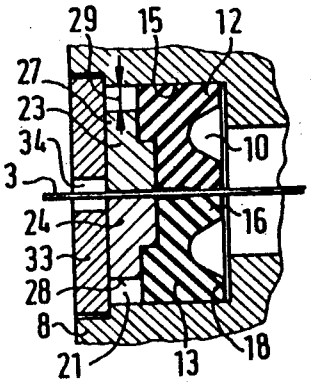
Figure 6:
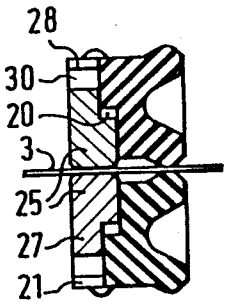
FIG. 2 to FIG. 6 show the arrangement of the sealing and guide elements in the non built-in state, relative to the band, and, in particular
Figure 5:
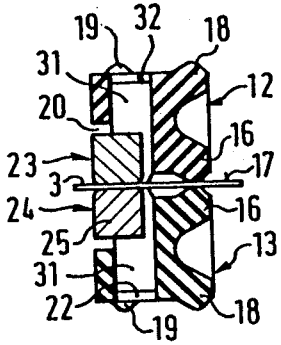
Figure 2:
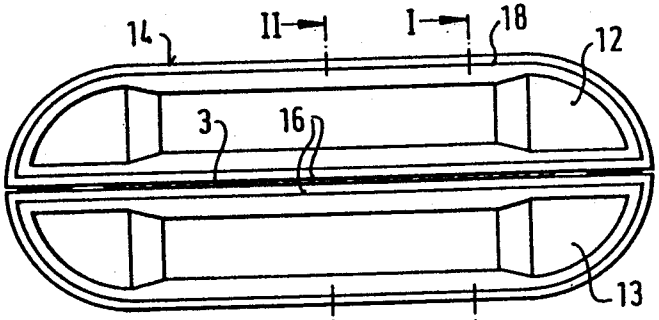

FIGS. 2 to 6 are enlarged views of the sealing and guide members in their arrangement relative to band 3, in uninstalled condition; FIG. 7 is an enlarged view showing them installed in receiving chamber 10. The sealing member has two identical sealing elements 12 and 13 which are made of elastic material, preferably an elastomer, and are arranged inversely to one another relative to band 3. The outer contour 14 of sealing elements 12 and 13 corresponds essentially to the contour of wall 15 of receiving chamber 10, so that, with slight, elastic deformation, which causes a contact pressure against band 3, sealing elements 12 and 13 can be inserted into receiving chamber 10. The elongated, strip-like sealing elements 12, 13 face the piston as a lip seal in such a manner that one lip 16 abuts against the wide side 17 of band 3 and the other lip 18 against wall 15 of receiving chamber 10. In the region of the outer contour 14 that adjoins lip 18, each sealing element 12, 13 has in both end regions of its elongated extension a pressure collar 19 whose cross-section is approximately triangular; upon installing the sealing elements 12, 13 into receiving chamber 10, the pressure collar 19 reinforces the elastic contact pressure against band 3. Due to its resistance to deformation that increases progressively when forced in, the triangular cross-section of the pressure collar supports the holding of the mirror plane of both sealing elements 12, 13 in the center position of receiving chamber 10. On its rear turned away from piston 2, each sealing element 12, 13 is provided with a first groove 20 parallel to the wide side 17 of band 3 and transverse to said band and is open relative to band 3 and to the rear. Furthermore, the sealing elements 12, 13 have in the center region of their longitudinal extension a second groove 21, which leads from the first groove 20 and leads from said groove at right angles to the outer contour 14. On both sides of groove 21 is a bore-like recess 22, which travels essentially parallel to the second groove 21 and empties with at least the bulk of its cross-section into the first groove 20.

On the rear side turned away from piston 2 at each sealing element 12, 13 is a guide element 23, 24 of the guide member; the guide elements 23, 24 are identical and are arranged mirror-inversely to band 3. The guide elements 23, 24 have an approximately rib-configured or rod-shaped body 25, which reaches into the first groove 20, leaving in the non-installed state of the sealing and guide members a distance 26 (FIG. 4) relative to the side wall of the groove. When the guide and sealing members are installed into the receiving chamber 10, this space is not present due to the elastic deformation of sealing elements 12 and 13. In the installed state, guide elements 23, 24 are forced flexibly against band 3 due to the elastic deformation of the sealing elements 12, 13. In the center, guide elements 23, 24 have an extension 27 which is located in the second groove 21 and ends with a stop face 28, which, when installed into the receiving chamber 10, is located with a clearance 29 in front of wall 15. Extension 27 is provided on the side of its stop face 28 with a recess 30 in which a tool to lift guide element 23, 24 out of grooves 20, 21 of sealing element 12, 13 can be introduced. On the side of the extension 27 the guide elements 23, 24 have pin shoulders 31 which extend into the recess as 22 and which end in stop faces 32 coplanar with stop faces 28 and, thus, when installed into the receiving chamber 10, are also located with a clearance 29 in front of wall 15. Guide elements 23, 24 are made of a form-stable material with a low coefficient of friction, such as ceramic, PTFE or an ultra high molecular low pressure polyethylene.

Receiving chambers 10, 11 are closed on their sides turned away from piston 2 by a cover 33, which is fastened detachably to cylinder covers 8, 9 and which has a slit 34 penetrated by band 3 with clearance on all sides, as shown in FIG. 7.

In the assembled state, the sealing lips 16 or 18 of sealing elements 12, 13 with elastic pre-stressing abut their respective counter-surfaces—the wide wall 17 or wall 15; and the elasticity of sealing elements 12, 13 simultaneously forces guide elements 23, 24 elastically against band 3. Sealing lips 16 also embrace with elastic deformation the narrow sides of band 3 and seal them. When a pressure medium is applied to the space located between sealing elements 12, 13 and piston 2, the contact force of lips 16, 18 is reinforced as a function of the amount of pressure applied, thus guaranteeing a tight seating; and at the same time, when band 3 is moved between said space and sealing lip 16, there is only slight friction as a function of the amount of pressure applied. Only slight frictional forces are also generated at guide elements 23, 24, which guide the band into its desired position; thus, the total friction of the sealing and guide members relative to bands 3,4 is kept low. When transverse force components occur, band 3 can be deflected by clearance 29 against the elastic deformation forces for sealing elements 12, 13; upon reaching a maximum deflection by this margin 29, the stop faces 28 and 29 of guide element 23, 24 contact wall 15 and brace this guide element 23, 24 form-lockingly so that no further deflection can take place.

Figure 4:
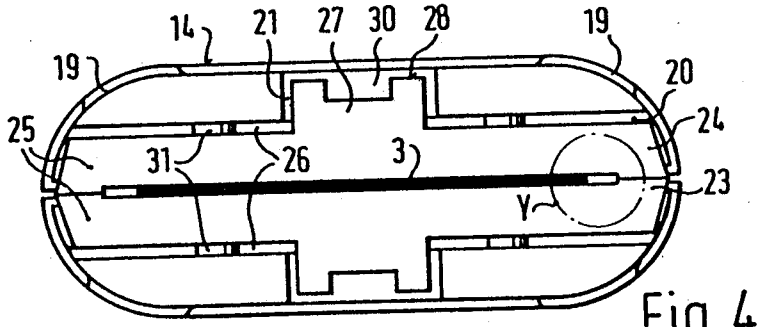
Figure 8:
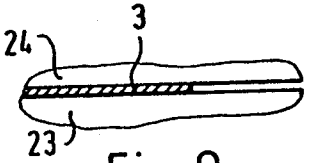
FIG. 8 shows a first embodiment of the guide elements.
Figure 9:
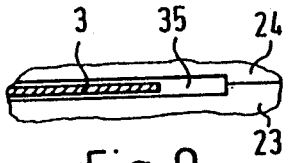
FIG. 9 shows a second embodiment of the guide elements.

FIGS. 8 and 9 are views of a segment of a circle Y of FIG. 4 on an enlarged scale. In a planar design of the surfaces of guide elements 23, 24 facing band 3 elements 23, 24, the conditions shown in FIG. 8 are obtained, i.e., guide elements 23 and 24 abut the wide sides 17 of band 3 with elastic contact pressure. In a variation, it is also possible, as shown in FIG. 9, to provide guide elements 23, 24 with a recess 35 on the band side. The depth of recess 35 corresponds to at least half the thickness of band 3; preferably it is larger by a slight margin, and the width of recess 35 is also larger than the width of band 3 by a slight margin. In the case of guide elements 23, 24 abutting each other in their lateral outer regions, the result in their center region is a slot formed by recesses 35, which slot can be penetrated by band 3 without any contact with guide elements 23, 24. In this embodiment, guide elements 23 and 24 brace each other; thus, they do not rest against band 3 and the latter in its desired position can penetrate the guide elements 23, 24 without friction. In this manner the total friction of bands 3 and 4 of the working cylinder is further reduced. In other variations the sealing elements can be compact seals with the omission of lips 16, 18, but this often results in greater friction.

What is claimed is:

1. Working cylinder devoid of a piston rod having at least one band (3,4) connecting a piston (2) to an output member (7), said band penetrating at least one cylinder cover (8,9) arranged at one end of a cylinder pipe (1) accommodating said piston (2), movably sealed, coaxially or concentrically to the piston (2), said cylinder cover (8,9) having a receiving chamber (10) penetrated by said band (3), being wider than said band (3) and having laterally rounded ends, and in which, facing the piston, two identical, strip-like sealing elements (12, 13) made of elastic material being located in said receiving chamber facing said piston, said sealing elements being forced against both wide sides (17) of said band by bracing against a wall (15) of said receiving chamber (10) with pre-stressing, and a band guide facing away from said piston and made of a form-stable material, said band guide comprising a slot for said band to pass through, said band guide being adapted to be braced against said wall (15) of said receiving chamber (10), wherein (a) each sealing element (12, 13) corresponding in its outer contour (14) essentially to the contour of said wall (15) of said receiving chamber (10) has on its side facing away from said piston a first groove (20) that extends parallel to a wide side (17) of said band (3) and transversely to said band and is open in the direction of said band;

(b) said band guide in the plane of said band is divided into two identical guide elements (23, 24), each of said guide elements (23, 24) having a bar-like body (25) reaching into said first groove (20);

(c) each sealing element (12, 13) has in a center region of its longitudinal extent a second groove (21), starting from said first groove (20), extending at a right angle to said first groove and leading to said outer contour (14);

(d) each said guide element (23, 24) has an extension (27) which reaches into said second groove (21) and which ends with clearance (29) in front of said wall (15) of said receiving chamber (10) with a stop face (28);

(e) and each guide element (23, 24) has on the side of said extension (27) a pin shoulder (31), said shoulder extending parallel to said extension and also ending with clearance (29) in front of said wall (15) of said receiving chamber (10) with a stop face (32), said pin shoulder being located in a bore-like recess (22) of said sealing element (12, 13).

2. Working cylinder according to claim 1, wherein said sealing element (12, 13) is made of an elastomer and said guide element (23, 24) is made of a material having low coefficients of friction.

3. Working cylinder according to claim 1, wherein said guide element is made of ceramic.

4. Working cylinder according to claim 1, wherein said guide element is made of PTFE.

5. Working cylinder according to claim 1, wherein said guide element is made of an ultra-high molecular low pressure polyethylene.

6. Working cylinder according to claim 1 or 2, wherein said sealing element (12, 13) on a side thereof facing said piston constitutes lip seal, said lip seal having one lip (16) which abuts against a wide side (17) of said band (3) and another lip (18) which abuts against said wall (15) of said receiving chamber (10).

7. Working cylinder according to claim 1 or 2, wherein each sealing element (12, 13) has in both end regions of its longitudinal extent on an outer contour side thereof a pressure collar (19) which abuts with pre-stessing against said wall (15) of said receiving chamber (10).

8. Working cylinder according to claim 7, wherein said pressure collars (19) have triangular cross-sections and extend longitudinally substantially transversely to said band (3).

9. Working cylinder according to claim 1 or 2, wherein said guide element (23, 24) has on a side thereof facing said recess (35) whose depth is at least one-half a thickness of said band (3) and whose length in a transverse direction of said band (3) is greater by a clearance margin than a width of said band.

10. Working cylinder according to claim 1 or 2, wherein said extension (27) reaching into said first groove (20) has a recess (30) on the side of said stop face (28).

11. Working cylinder according to claim 1 or 2, wherein said receiving chamber (10) on a side thereof remote from said piston is closed by a cover (33) detachably held on said cylinder cover (8, 9), said cover (33) having a slot (34) therein penetrated by said band (3) with clearance on all sides.

* * * * *